US006148624A

United States Patent [19]

Bishop et al.

[11] Patent Number: 6,148,624

[45] Date of Patent: Nov. 21, 2000

[54] ICE MAKING SYSTEM FOR A REFRIGERATOR

[75] Inventors: Donald L. Bishop, Berrien Springs; Rodney S. Goodrich, Watervliet; Mark H. Nelson, Berrien Springs; Jim J. Pastryk, New Troy, all of Mich.

[73] Assignee: Whirlpool Corporation, Benton Harbor, Mich.

[21] Appl. No.: 09/221,907

[22] Filed: Dec. 28, 1998

[51] Int. Cl.[7] ..... F25C 5/18

[52] U.S. Cl. ..... 62/137; 62/344

[58] Field of Search ..... 62/137, 344; 222/156; 200/61.2, 61.21

[56] References Cited

U.S. PATENT DOCUMENTS

| | | | |
|---|---|---|---|
| 2,568,332 | 9/1951 | Genovese | 222/156 |
| 2,785,539 | 3/1957 | Simmons et al. | 62/108.5 |
| 3,025,683 | 3/1962 | Baker et al. | 62/419 |
| 3,146,601 | 9/1964 | Gould | 62/344 |
| 3,436,928 | 4/1969 | Swebinsky | 62/344 |
| 3,545,217 | 12/1970 | Linstromberg | 62/137 |
| 3,602,007 | 8/1971 | Drieci | 62/344 |
| 3,621,668 | 11/1971 | Swerbinsky | 62/137 |
| 3,635,043 | 1/1972 | Sterling | 62/137 |
| 3,747,363 | 7/1973 | Grimm | 62/377 |
| 4,100,761 | 7/1978 | Linstromberg et al. | 62/137 |
| 4,719,762 | 1/1988 | Osabe | 62/137 |
| 4,970,871 | 11/1990 | Rudick | 62/187 |
| 5,187,950 | 2/1993 | Weldon | 62/449 |
| 5,272,888 | 12/1993 | Fisher et al. | 62/344 |

*Primary Examiner*—William E. Tapolcai

*Attorney, Agent, or Firm*—Stephen D. Krefman; Joel M.Van Winkle; Robert O. Rice

[57] ABSTRACT

A refrigerator having a cabinet forming a freezer compartment having an access opening. A closure member is hingedly connected to the cabinet for closing the access opening and an ice maker is mounted on the closure member. An ice bucket or storage receptacle is mounted to the closure member below the ice maker. A support rail is provided along the inner surface of the closure member wherein the ice maker is vertically movable along the support rail. The ice maker has an ice level sensor and the amount of ice supplied to the ice bucket is controlled by the vertical position of the ice maker. The ice bucket is pivotably mounted to the closure member and can be pivoted between an orientation wherein the ice bucket is positioned adjacent the closure member substantially under the ice maker and an orientation wherein the ice bucket is pivoted away from the closure member. The ice bucket is a pitcher-like receptacle having a handle and is removable from the closure member.

14 Claims, 5 Drawing Sheets

ICE MAKING SYSTEM FOR A REFRIGERATOR

BACKGROUND OF THE INVENTION

1. Field of the Invention

The invention relates to an ice making system for a refrigerator and more particularly to an ice making system mounted to a refrigerator closure member or door.

2. Description of Related Art

Automatic ice making systems for use in a home refrigerator are well known. Typically, ice making systems include an icemaker mounted within the freezer compartment of the refrigerator and an ice storage receptacle or bin supported beneath the ice maker for receiving the formed ice from the ice maker. The ice maker is commonly mounted within the freezer compartment adjacent the top or rear wall of the freezer compartment such that water and power can be readily supplied to the ice maker. U.S. Pat. No. 4,872,318, to Klemmensen is an example of a prior art ice making system.

As can be seen in Klemmensen, one aspect of conventional an ice making systems is that they occupy a relatively large amount of freezer shelf space. This is perceived as a disadvantage by many consumers who generally prefer to have more available shelf space. Accordingly, it would be an improvement to provide an ice making system which occupied less freezer shelf space.

Another aspect of conventional ice making systems is that they produce a fixed quantity of ice pieces. This leads to the problem of ice staleness for consumers who have relatively low ice consumption needs. U.S. Pat. No. 4,835,978, to Cole, discloses a common means used to limit the quantity of ice formed by the ice maker. In Cole, an ice quantity sensor comprising a sensing arm is periodically lowered into the ice storage receptacle for sensing the amount of ice supplied into the storage receptacle.

To avoid the problem of ice staleness, it is desirable to limit the amount of ice available based on individual consumers ice consumption. U.S. Pat. Nos. 5,619,858 and 4,719,762 illustrate past efforts to provide flexibility in the amount of ice produced and supplied to an ice bin. These references teach the use of a variable height ice sensing arm.

SUMMARY OF THE INVENTION

One object of the present invention is to provide an ice making system which does not occupy shelf space in a refrigerator freezer compartment.

Another object is to provide an ice making system which is supported on a freezer compartment door such that the ice making system does not occupy freezer shelf space.

Another object of the present invention is to provide an ice making system which allows a consumer to easily visually determine the amount of ice available.

Yet another object is to provide a removable ice storage receptacle which may be readily removed for bulk ice dispensing.

Still another object of the present invention is to provide an ice maker vertically adjustable such that the quantity of ice produced can be optimally controlled.

According to the present invention, the foregoing and other objects are attained by a refrigerator having a cabinet forming a freezer compartment having an access opening. A closure member is hingedly connected to the cabinet for closing the access opening and an ice maker is mounted on the closure member. An ice storage receptacle or bucket is mounted to the closure member below the ice maker. A support rail is provided along the inner surface of the closure member wherein the ice maker is vertically movable along the support rail. The ice maker has an ice level sensor and the amount of ice supplied to the ice bucket is controlled by the vertical position of the ice maker. The ice bucket is pivotably mounted to the closure member and can be pivoted between an orientation wherein the ice bucket is positioned adjacent the closure member substantially under the ice maker and an orientation wherein the ice bucket is pivoted away from the closure member. The ice bucket is a pitcher-like receptacle having a handle and is removable from the closure member.

DESCRIPTION OF THE PREFERRED EMBODIMENTS

Figure 1:
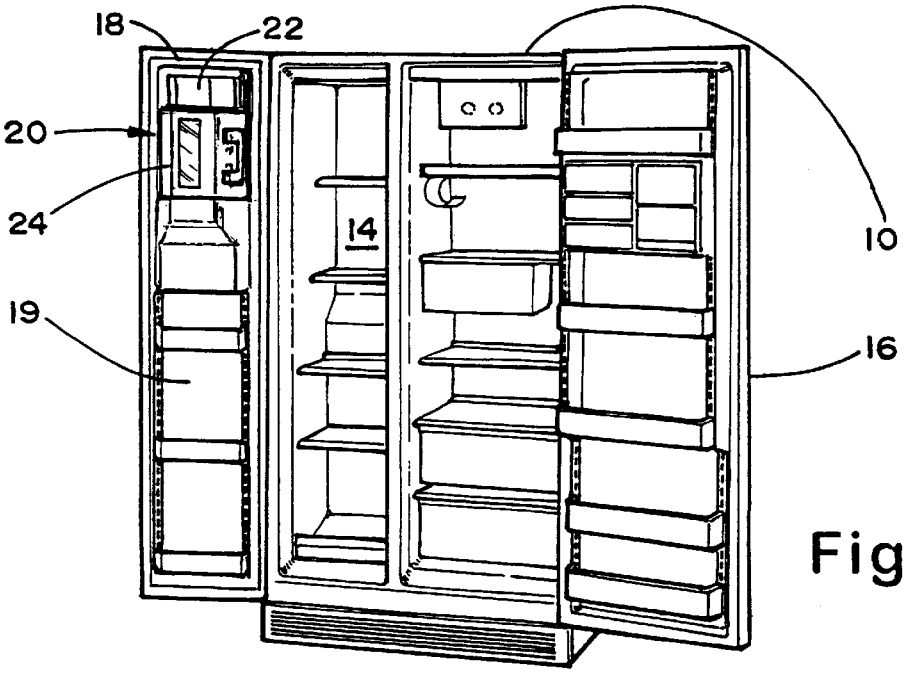
FIG. 1 is a top, front perspective view of a refrigerator embodying the ice making system of the present invention.

In FIG. 1 is shown a front, top perspective view of a refrigerator 10. The refrigerator 10 has a outer cabinet disposed generally about a fresh food compartment and a freezer compartment 14. A fresh food compartment closure member or door 16 and a freezer closure member or door 18 are hingedly supported for allowing access to the fresh food and freezer compartments. An ice making system 20 is mounted to the inner surface 19 of the freezer door 18, preferably near the top of the freezer door 18.

Figure 3:
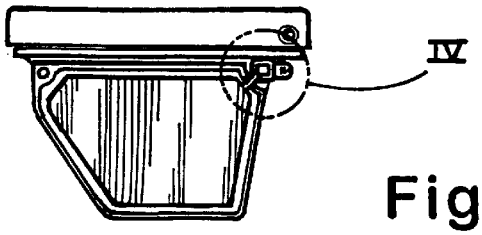
FIG. 3 is a view taken along line 3—3 of FIG. 2.
Figure 4:
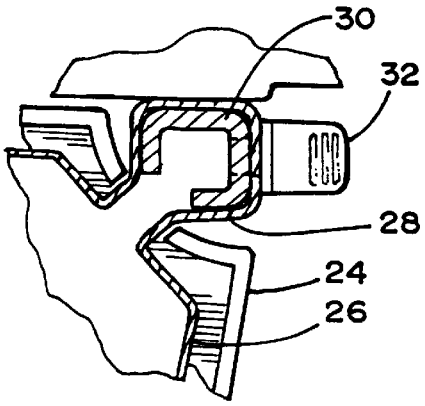
FIG. 4 is a detailed view of area A, shown in FIG. 3.
Figure 2:
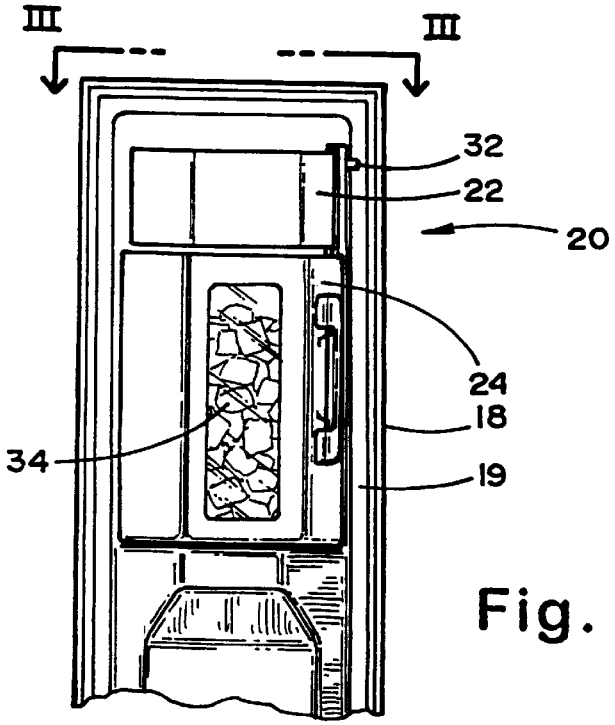
FIG. 2 is a front elevational view of the ice making system of FIG. 1.

As seen more clearly in FIGS. 2, 3 and 4, the ice making system 20 includes an ice maker 22 and a ice receptacle or bucket 24 for receiving the ice formed by the ice maker 22. The ice maker may be of a type shown in U.S. Pat. No. 4,835,978, to Cole, incorporated herein by reference. However, in order to reduce the size of the ice maker 22, the number and size of the ice forming cavities may be reduced from what is taught in Cole.

The ice maker 22 includes an outer frame 26 from which extends a sleeve 28 slidably engaging a support rail 30 provided along the inner surface 19 of the freezer door 18. The support rail 30 is vertically arranged along the freezer door 18 and includes a plurality of notches or apertures (not shown). The ice maker sleeve 28 is provided with a flexible catch or tab 32 which can releasably engage the rail apertures such that the sleeve 28 can vertically slide along the rail 30 and be secured in a plurality of different positions. In this manner, the ice maker 22 is supported for vertical rectilinear movement along the rail 30. A flexible power line and water line supplies the ice maker with water and power and allow the ice maker 22 to ride up and down along the rail 30.

Figure 6:
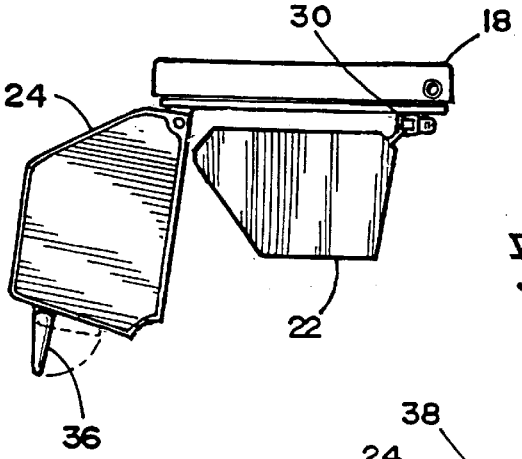
FIG. 6 is a view taken along line 6—6 of FIG. 5.
Figure 5:
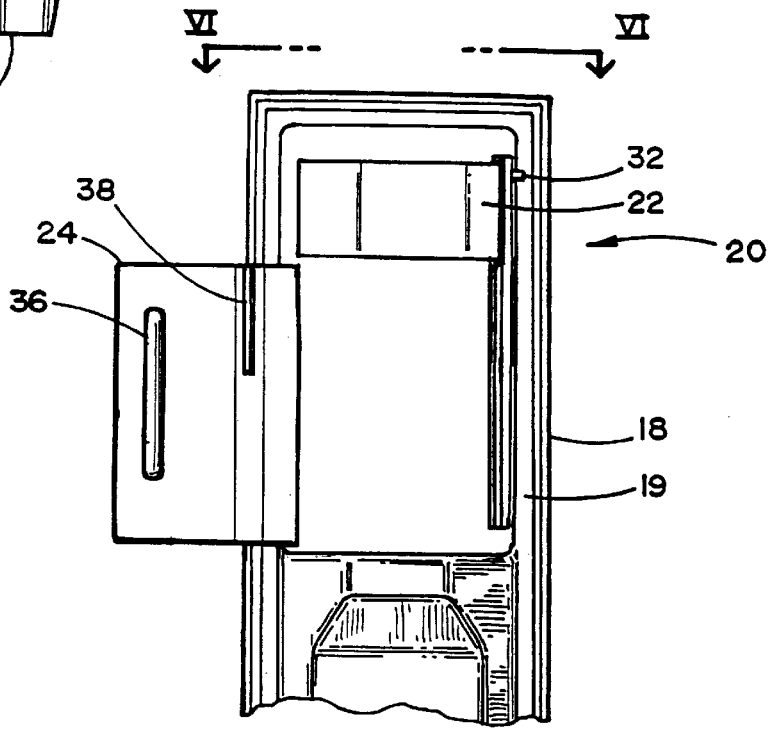
FIG. 5 is a front elevational view of the ice making system of FIG. 1, showing the ice bucket pivoted away from the freezer door.
Figure 7:
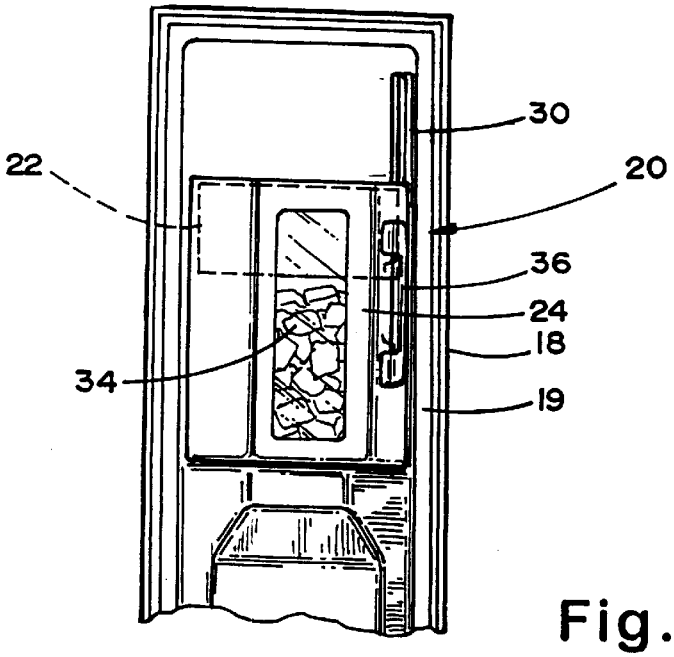
FIG. 7 is a front, elevational view of the ice making system of FIG. 1, showing the ice maker in a lowered position.

Disposed beneath the ice maker 22 is the ice bucket 24. The ice bucket 24 includes a window 34 for viewing the quantity of accumulated ice in the bucket. As shown in FIGS. 2, 5 and 6, the ice bucket 24 is pivotably and removably mounted to the inner surface 19 of the freezer door 18. This may be accomplished by providing pins along one of the rear edges of the ice bucket 24 for insertion into corresponding holes provided along the inner surface 19 of the freezer door 18. A pivotable handle 36 is provided on the bucket 24. When bulk ice dispensing is desired, such as when filling a cooler with ice, the bucket 24 may be pivoted away from the freezer door 18 and disengaged from the inner surface 19. By grasping the handle 36 of the bucket 24, the bucket functions as a pitcher-like container for readily pouring ice.

The ice maker 22 includes a means for sensing the presence of ice in the bucket 24, such as disclosed in Cole, previously incorporated by reference. The quantity of ice produced by the ice maker 22 can be varied by adjusting the vertical position of the ice maker 22 relative to the bucket 24. As shown in FIG. 2, when the ice maker 22 is positioned in its upper most vertical position, the bucket 24 is completely filled with ice pieces. When the ice maker 22 is moved vertically down, to a position within the bucket 24, relatively less ice is produced. To accommodate this insertion of the ice maker 22 down into the ice bucket 24, a slot 38 (see FIG. 5) is provided in the bucket 24 through which the sleeve 28 extends for engaging the rail 30.

Alternatively, an ice making system mounted to the freezer door may be provided where the quantity of ice is adjusted by providing an ice bucket which is movable relative to the ice maker. The position of the ice bucket along a vertical rail would control the quantity of ice produced.

By reference to FIG. 5, it can be readily understood that the ice maker 22 must be in its uppermost position to allow the bucket 24 to pivot away from the freezer door 18.

Figure 8:
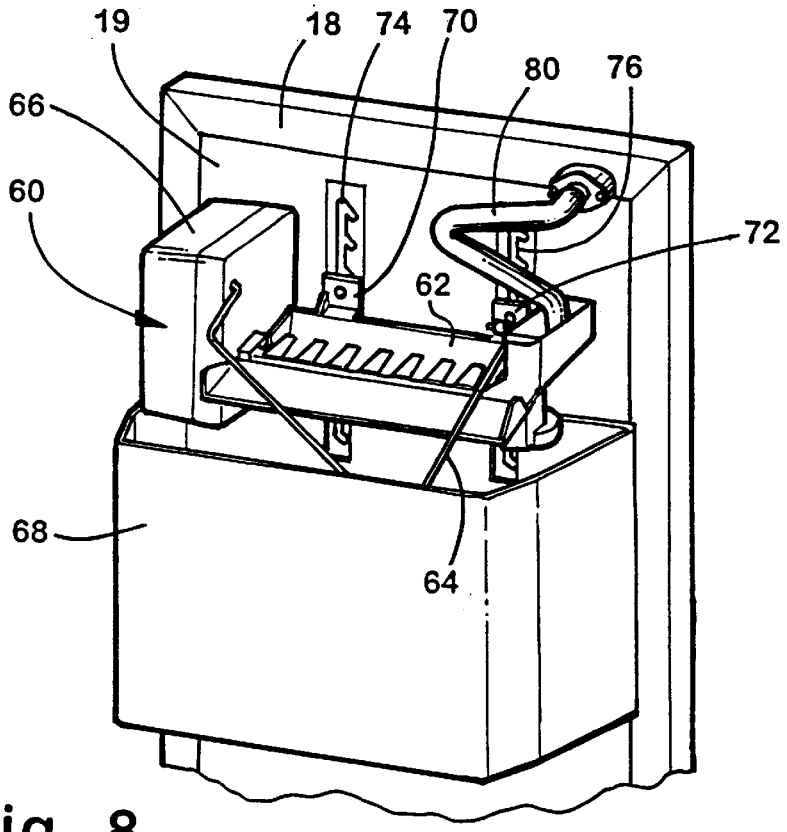
FIG. 8 is a top, front perspective view of an alternate embodiment of the ice making system of the present invention.
Figure 9:
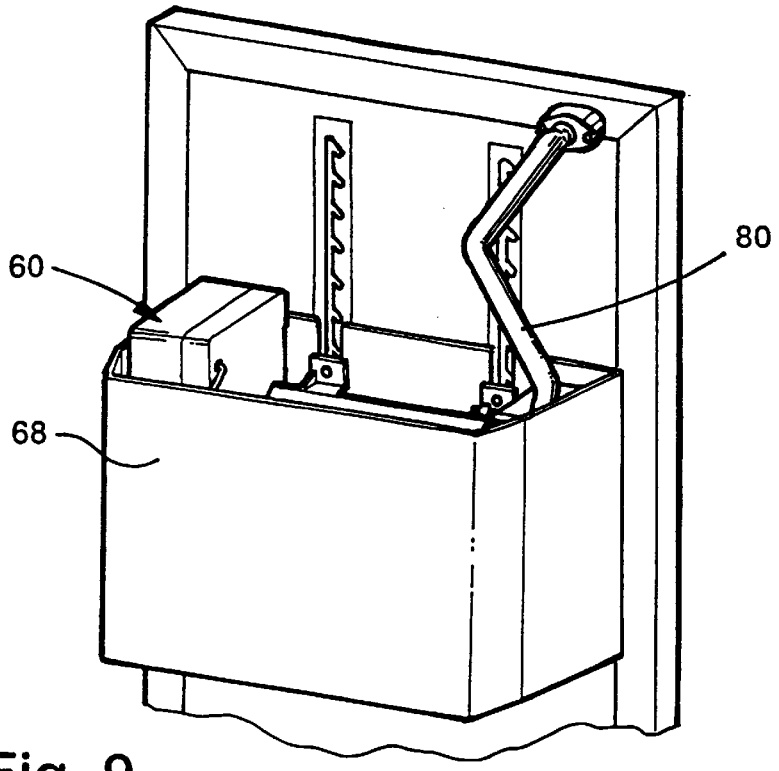
FIG. 9 is a top, front perspective view of the ice making system of FIG. 8, showing the ice maker in its lowest vertical position.
Figure 10:
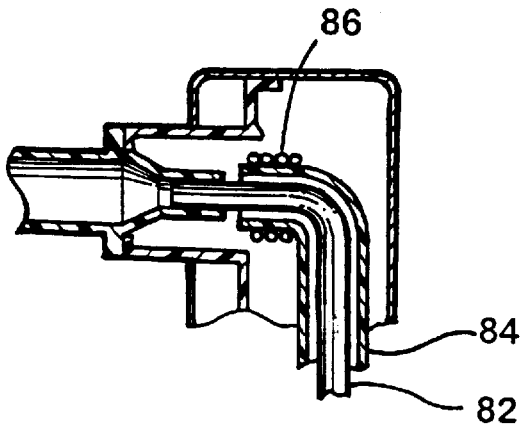
FIG. 10 is a fragmentary, side sectional view of the water supply system for the ice making system of FIG. 8.

FIGS. 8–10 disclose a first alternative embodiment of the present invention. In this embodiment, an ice maker assembly 60 is movably mounted to the inner surface 19 of the freezer door 18. The ice maker includes conventional components including a mold 62, a bin sensing arm 64 and a control module 66. An ice storage bin 68 is also mounted to the freezer door 18 below the ice maker 60. In this manner, ice pieces harvested from the ice maker are delivered into the ice storage bin 68.

The ice maker 60 is movably mounted to the freezer door 18. To achieve this, the ice maker is provided with a pair of mounting tabs 70, 72. Extending from the back surface of each of these mounting tabs 70, 72 is a pin having a retention head (not shown). A pair of mounting strips 74, 76 are provided along the freezer door 18. Each mounting strip 74, 76 includes a slot having a plurality of notches. The pins are received into the slots 74, 76 such that the ice maker 60 may be rectilinearly moved and supported in a plurality of different vertical positions. The retention head on each pin ensures that the ice maker 60 can not be removed from the freezer door 18.

The quantity of ice pieces produced by the ice maker 60 can be varied by vertically moving the ice maker 60. FIG. 9 shows the ice maker 60 in its lowest position. In this position, the minimum amount of ice pieces will be made.

Water is supplied to the ice maker 60 by a flexible water fill tube 80. As shown in FIGS. 8 and 9, as the ice maker 60 is lowered, the flexible tube 80 unfolds such that water is readily supplied to the ice maker 60 at any vertical position.

FIG. 10 illustrates how the water fill tube 80 is connected to a water supply line 82 which is provided in the freezer door 18. As shown, the water supply line is provided within a conduit 84. A heater 86 is disposed on the conduit 84 for ensuring that the water within the supply line 82 does not freeze.

Figure 11:
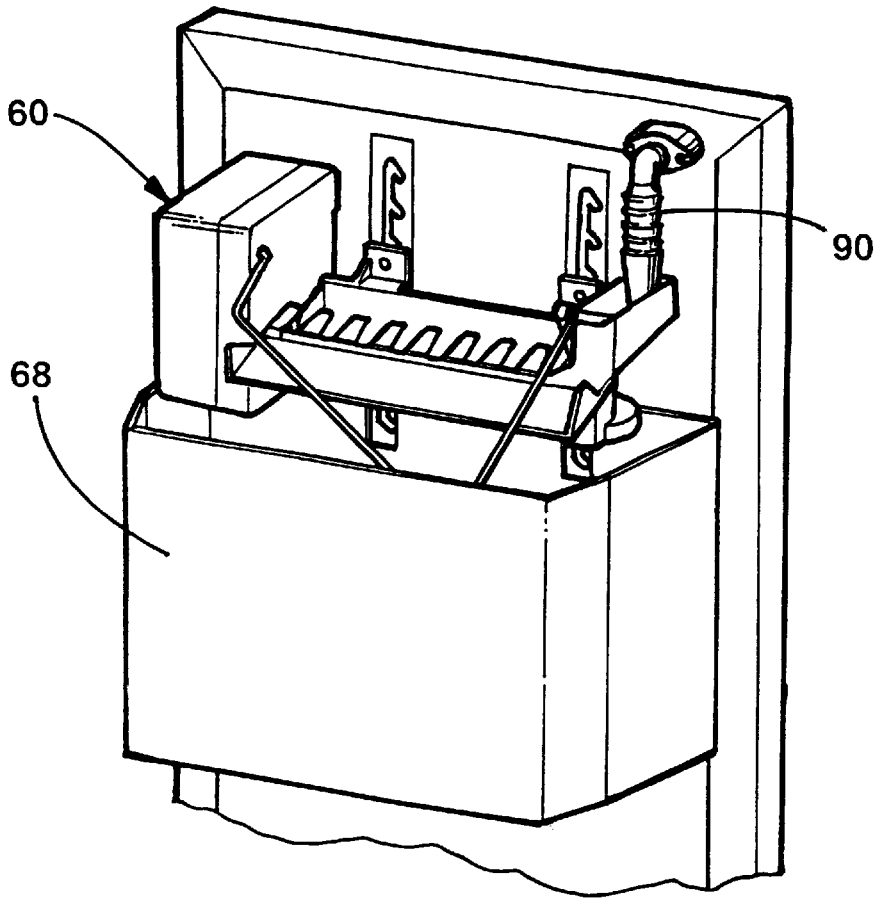
FIG. 11 is a top, front perspective view of a second alternate embodiment of the ice making system of the present invention.
Figure 12:
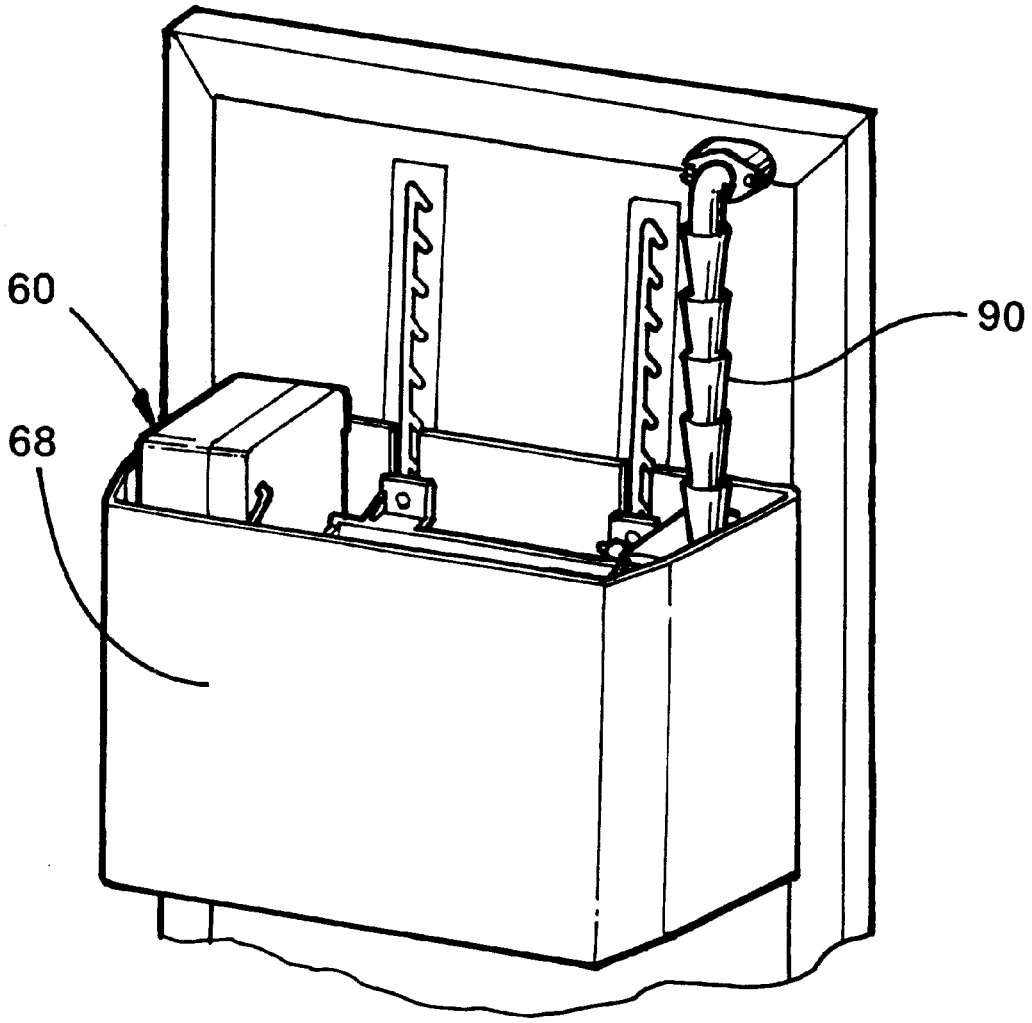
FIG. 12 is a top, front perspective view of the ice making system of FIG. 11, showing the ice maker in its lowest vertical position.

FIGS. 11 and 12 illustrate an alternative water tube design. In these FIGS., a telescoping fill tube 90 is provided for supplying water to the ice maker 60. As the ice maker is vertically lowered, the telescoping fill tube 90 extends or telescopes to allow for water supply to the ice maker at any vertical height.

While the present invention has been described with reference the above described embodiment, those of skill in the Art will recognize that changes may be made thereto without departing from the scope of the invention as set forth in the appended claims.

We claim:

1. A refrigerator comprising:

a cabinet forming a freezer compartment having an access opening;

a closure member hingedly connected to the cabinet for closing the access opening;

an ice maker mounted on the closure member;

an ice storage receptacle mounted to the closure member below the ice maker for receiving ice from the ice maker; and a support rail vertically disposed along the closure member wherein the ice maker is vertically movable along the support rail.

2. The refrigerator according to claim 1, further comprising:

vertically movable conduit means connected to the ice maker for supplying liquid to the ice maker for forming into ice pieces.

3. The refrigerator according to claim 1 wherein the amount of ice supplied to the ice storage receptacle is controlled by the vertical position of the ice maker.

4. The refrigerator according to claim 1 wherein the ice maker has an ice level sensor and the amount of ice supplied to the ice storage receptacle is controlled by the vertical position of the ice maker.

5. A refrigerator comprising:

a cabinet forming a freezer compartment having an access opening;

a closure member hingedly connected to the cabinet for closing the access opening;

an ice maker mounted on the closure member; and an ice storage receptacle mounted to the closure member below the ice maker for receiving ice from the ice maker;

wherein the ice storage receptacle is pivotably mounted to the closure member and can be pivoted between an orientation wherein the ice storage receptacle is positioned adjacent the closure member substantially under the ice maker and an orientation wherein the ice storage receptacle is pivoted away from the closure member.

6. The refrigerator according to claim 5 wherein the ice storage receptacle is removable from the closure member.

7. The refrigerator according to claim 6 wherein the ice storage receptacle is a pitcher-like receptacle having a handle.

8. The refrigerator according to claim 7 wherein the ice storage receptacle includes a window for viewing the accumulation of ice therein.

9. A refrigerator comprising:

a cabinet forming a freezer compartment having an access opening;

a closure member hingedly connected to the cabinet for closing the access opening;

an ice maker movably supported on the closure member for vertical rectilinear movement; and an ice storage receptacle mounted to the closure member below the ice maker for receiving ice from the ice maker, wherein the amount of ice supplied to the ice storage receptacle is controlled by the vertical position of the ice maker.

10. The refrigerator according to claim 9 wherein the ice storage receptacle is pivotably mounted to the closure member and can be pivoted between an orientation wherein the ice storage receptacle is positioned adjacent the closure member substantially under the ice maker and an orientation wherein the ice storage receptacle is pivoted away from the closure member.

11. The refrigerator according to claim 9 wherein the ice storage receptacle is removable from the closure member.

12. The refrigerator according to claim 11 wherein the ice storage receptacle is a pitcher-like receptacle having a handle.

13. The refrigerator according to claim 9 wherein the ice storage receptacle includes a window for viewing the accumulation of ice therein.

14. The refrigerator according to claim 9, further comprising:

vertically movable conduit means connected to the ice maker for supplying liquid to the ice maker for forming into ice pieces.

* * * * *